United States Patent [19]

Brevick

[11] Patent Number: 4,544,811

[45] Date of Patent: Oct. 1, 1985

[54] ELECTRIC SWITCH

[75] Inventor: Arnold A. Brevick, Hamilton, Ill.

[73] Assignee: Methode Electronics, Inc., Chicago, Ill.

[21] Appl. No.: 618,477

[22] Filed: Jun. 8, 1984

[51] Int. Cl.[4] ..... H01H 9/30

[52] U.S. Cl. ..... 200/5 R; 200/10; 200/67 C; 200/146 R

[58] Field of Search ..... 200/5 R, 10, 144 R, 200/146 R, 67 C, 153 SC, 340, 339

[56] References Cited

U.S. PATENT DOCUMENTS

| | | | |
|---|---|---|---|
| 1,837,812 | 12/1931 | Greenwood | 200/146 R |
| 2,025,697 | 12/1935 | Baker | 200/146 R |
| 2,761,040 | 8/1956 | Ulrich | 200/146 R |
| 3,184,561 | 5/1965 | Heath | 200/67 C |
| 3,805,200 | 4/1974 | Suzuki | 200/146 R |
| 3,879,592 | 4/1975 | Comerford et al. | 200/339 X |

*Primary Examiner*—A. D. Pellinen
*Assistant Examiner*—Morris Ginsburg
*Attorney, Agent, or Firm*—Charles F. Pigott, Jr.

[57] ABSTRACT

An electric switch having a tactile feel and capable of carrying high current without requiring the use of relays, the switch being resistant to arcing damage by effecting sequential making and breaking at different contact points.

5 Claims, 11 Drawing Figures

FIG. 3
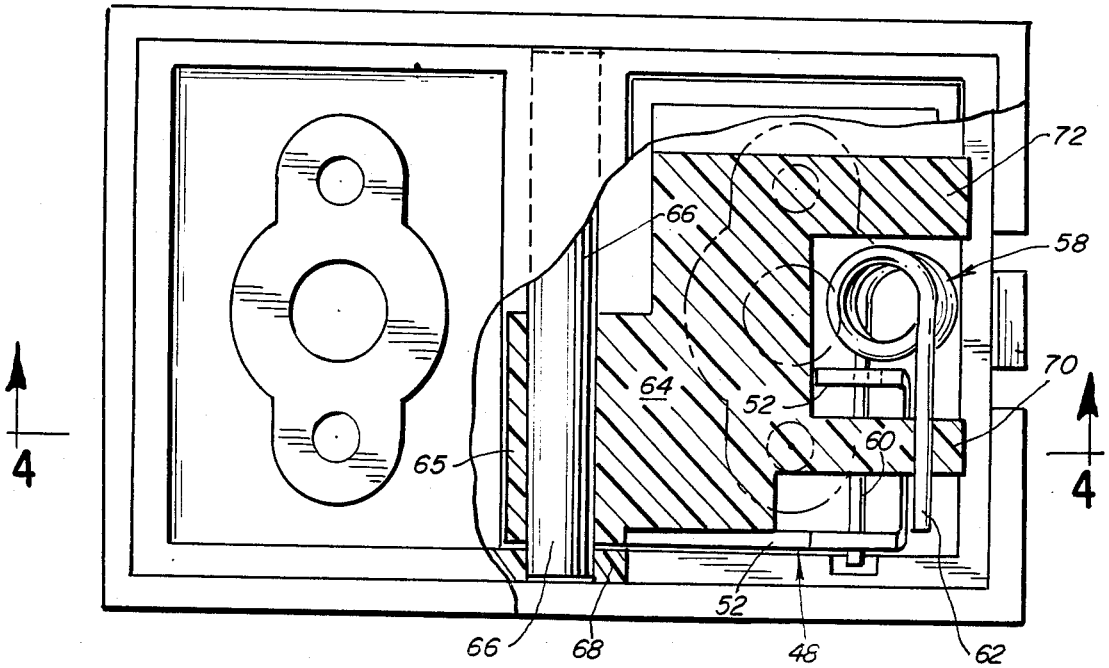
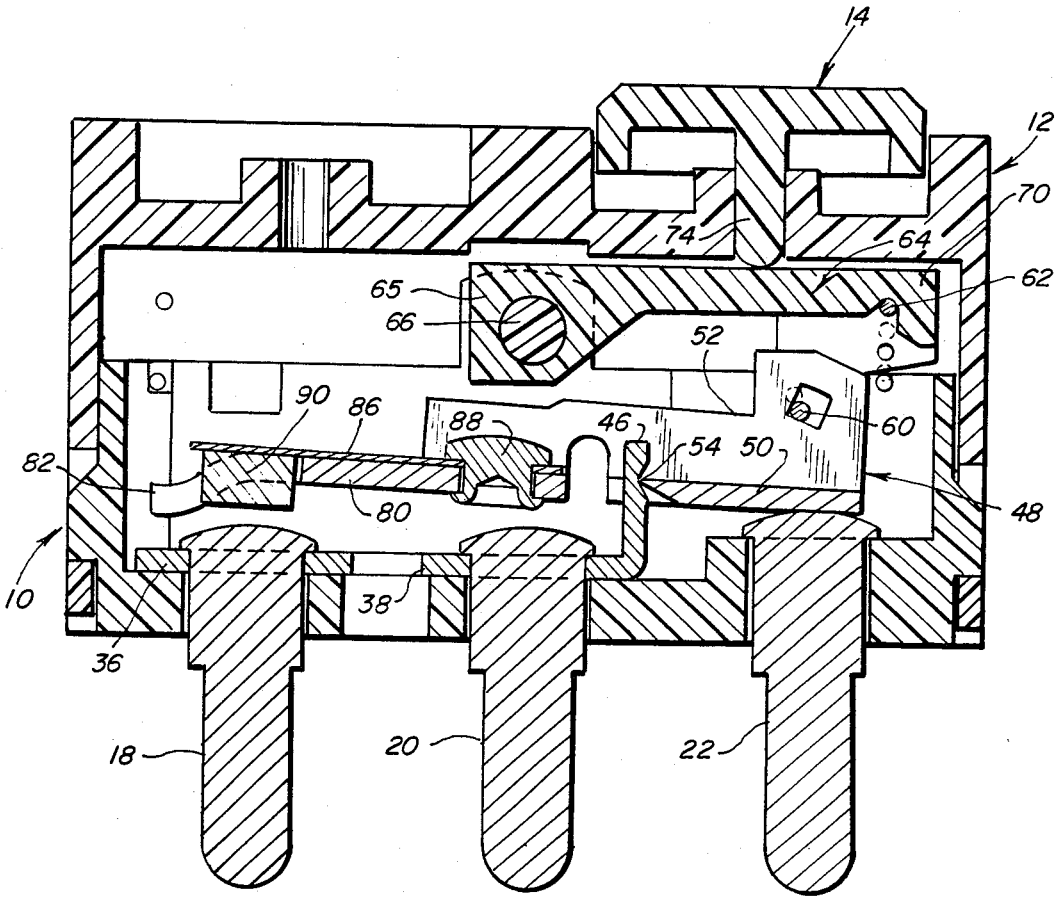
FIG. 4A

FIG. 4B
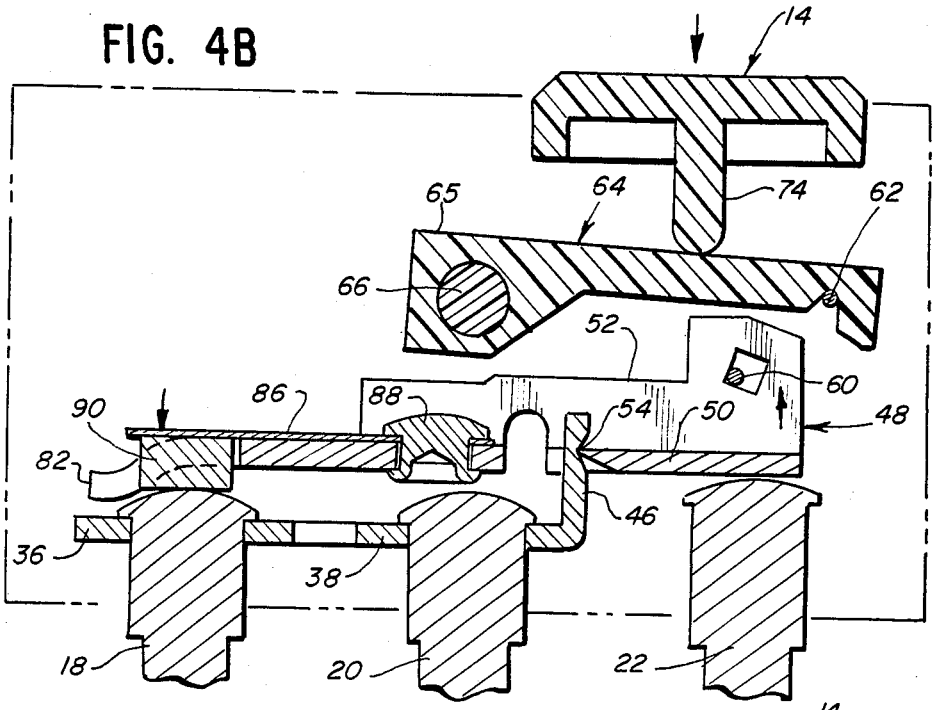
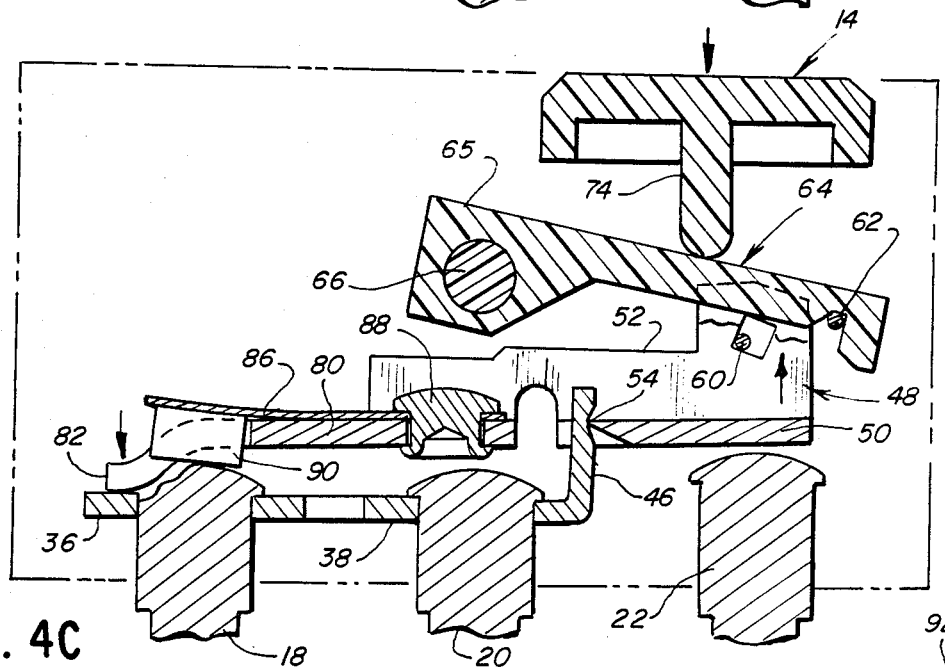
FIG. 4C
FIG. 5
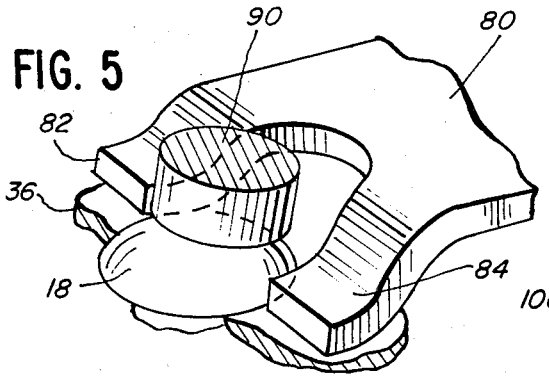
FIG. 6A
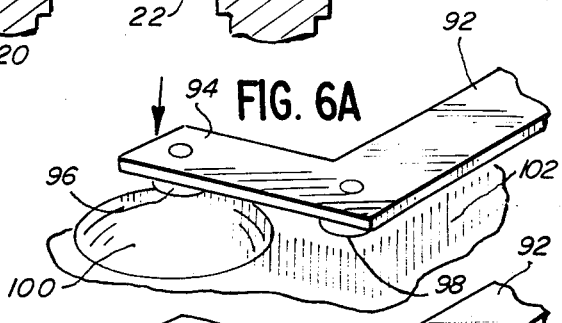
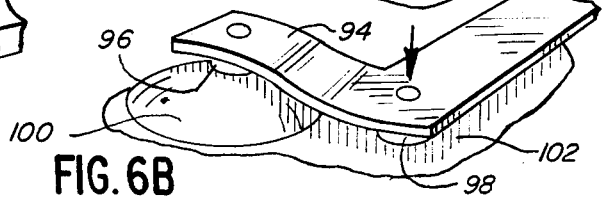
FIG. 6B FIG. 7
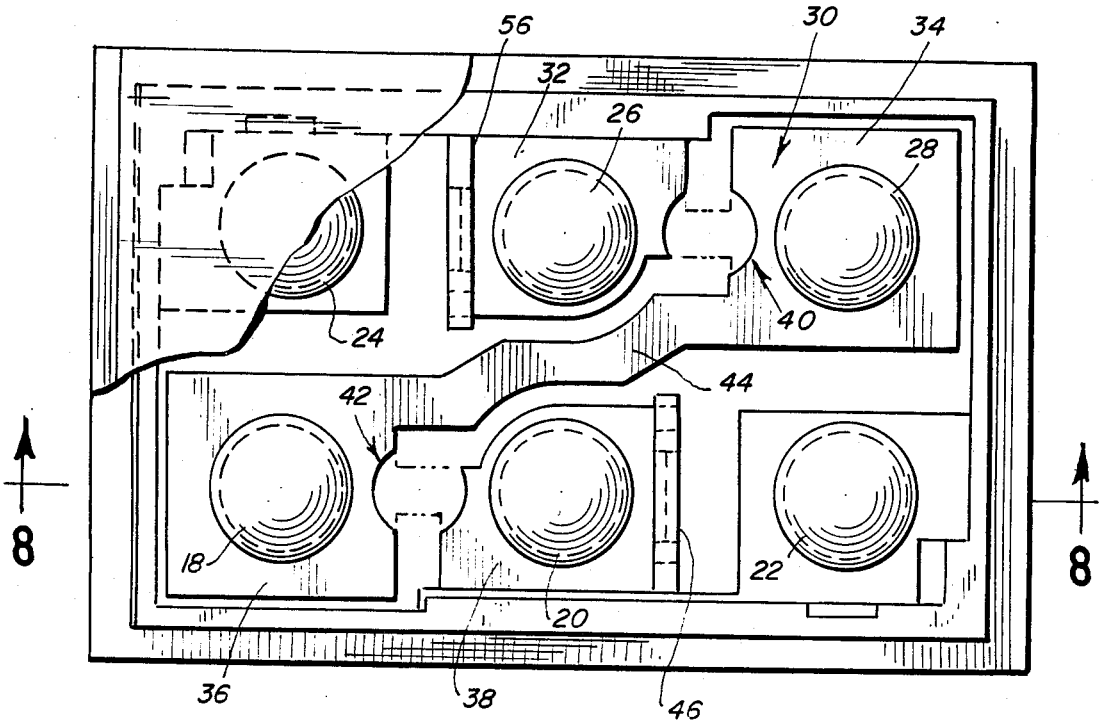
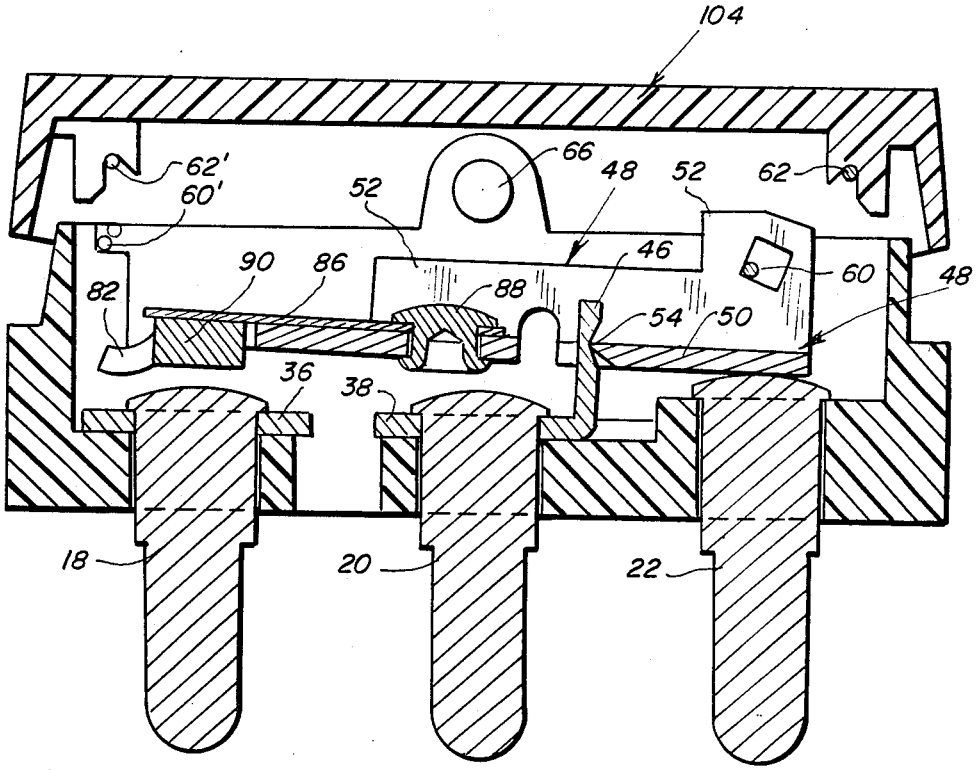
FIG. 8

ELECTRIC SWITCH

BRIEF SUMMARY OF THE INVENTION

The present invention relates to an electric switch which is capable of carrying high current without requiring the use of relays. In addition, the switch of the present invention affords a tactile feel to the operator, and is basically a low travel type switch.

Normally, low travel switches which offer a tactile feel are not adapted for handling high current, and thus such switches are generally used in conjunction with relays. It is therefore an object of this invention to provide a low travel switch which affords a tactile feel and can carry high current without the need for relays.

It is another object of the invention to provide an electric switch which reduces arcing damage by providing sequential making and breaking at different contact points.

A further object of my invention is to provide an electric switch as last above-mentioned which affords rapid snap action of a contactor so that the sequential making or breaking occurs in rapid sequence thereby reducing the time that current must be conducted solely at the initial contact point.

The foregoing and other objects and advantages of my invention will be apparent from the following description of certain preferred embodiments, taken in conjunction with the accompanying drawings.

DESCRIPTION OF THE DRAWINGS

FIG. 3 is a view taken substantially along line 3—3 of FIG. 2, a portion of the housing being broken away to illustrate interior components;

FIG. 4A is a sectional view taken substantially along line 4—4 of FIG. 3, the illustrated push button being shown in its normal raised position;

FIGS. 4B and 4C are views similar to FIG. 4A showing the push button in partially depressed and fully depressed positions;

FIG. 5 is a fragmentary perspective view showing components which effect sequential making and breaking at different contact points;

FIGS. 6A and 6B are fragmentary perspective views illustrating an alternative form of apparatus for effecting sequential making and breaking at different contact points;

FIG. 7 is a top plan view of certain interior components of the switch assembly; and FIG. 8 is a vertical sectional view taken substantially along line 8—8 of FIG. 7, but it further shows a modified form of the invention.

Now, in order to acquaint those skilled in the art with the manner of making and using my invention, I shall describe, in conjunction with the accompanying drawings, certain preferred embodiments of the invention.

DETAILED DESCRIPTION OF THE INVENTION

Figure 1:
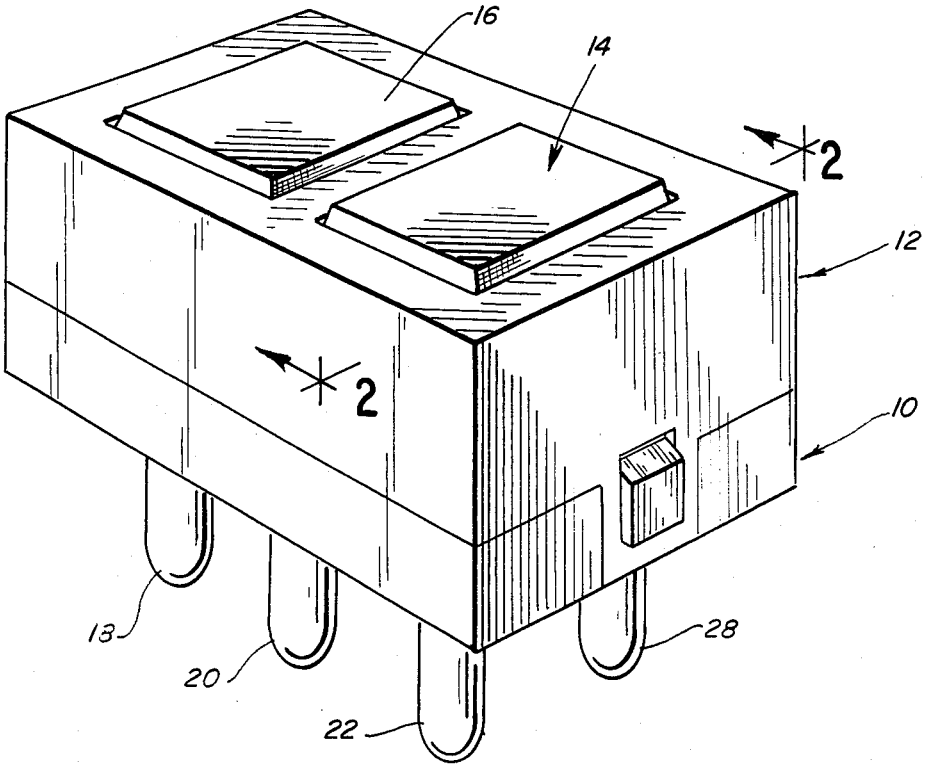
FIG. 1 is a perspective view of a switch assembly constructed in accordance with the present invention and having two push buttons for actuating the switch.

Referring now to the drawings, there is provided a switch housing comprising a base member 10 and a cover 12, and the cover 12 is provided with two openings as shown in FIG. 1 to permit a pair of push buttons

14 and 16 to project up through the cover for manual actuation by an operator. As shown in FIGS. 4, 7 and 8, there are six metal contacts in the form of rivets pressed down through respective spaced openings in the bottom wall of the base 10, such rivets being indicated at 18, 20, 22, 24, 26 and 28 and being arranged in two parallel rows as shown in FIG. 7. FIGS. 4 and 8 show the rivets prior to final assembly when they are preferably staked at the underside of the base 10 to prevent upward movement relative to the base.

A metal sheet 30 (see FIG. 7) of copper or other conductive material is mounted within the housing on the base 10 before the six contact rivets 18–28 are pressed into the base, and in this manner the conductive sheet 30 is fixed to the base by the six rivet heads. In a preferred embodiment, the sheet 30 when first laid on the base 10 comprises one integral sheet which includes four portions shown in FIG. 7 at 32, 34, 36 and 38 which lie under the respective rivet heads 26, 28, 18 and 20. After installation of the sheet 30, the sheet is pierced away in the two areas shown enclosed by the circles 40 and 42 in FIG. 7 so as to leave the sections 32 and 38 separated from other sections, while the sections 34 and 36 remain interconnected by a shorting strap 44.

The conductive metal plate portion 38, which is separated from the other plate sections after the piercing operation, includes an upwardly bent mounting arm 46 (as best shown in FIG. 4) on which a contactor 48 is pivotally mounted. The contactor 48 is generally U-shaped in cross section (see FIG. 2) and includes a base 50 and a pair of upright walls 52. The contactor 48 is supported on the arm 46 and is pivotally movable thereon about a pivot indicated at 54. It will be noted from FIG. 7 that the plate section 32 similarly includes an upright supporting arm 56, and as will be explained more fully later herein, a second contactor 48 may be pivotally mounted on arm 56.

FIG. 4A shows the contactor 48 in its clockwise or neutral position in which the right-hand end thereof is engaged with the head of contact rivet 22. It will be understood that when contactor 48 is in the foregoing clockwise or neutral position, a circuit is completed between the contact rivets 20 and 22, such circuit including the plate section 38 with its mounting arm 46. It will further be understood that if a similar contactor 48 is pivotally mounted on the mounting arm shown at 56 in FIG. 7, then when positioned in a similar counterclockwise or neutral position, it will make a circuit between the contact rivets 24 and 26. Since a second contactor mounted on arm 56 would be of the same construction as contactor 48, only the latter will be described herein.

Figure 2:
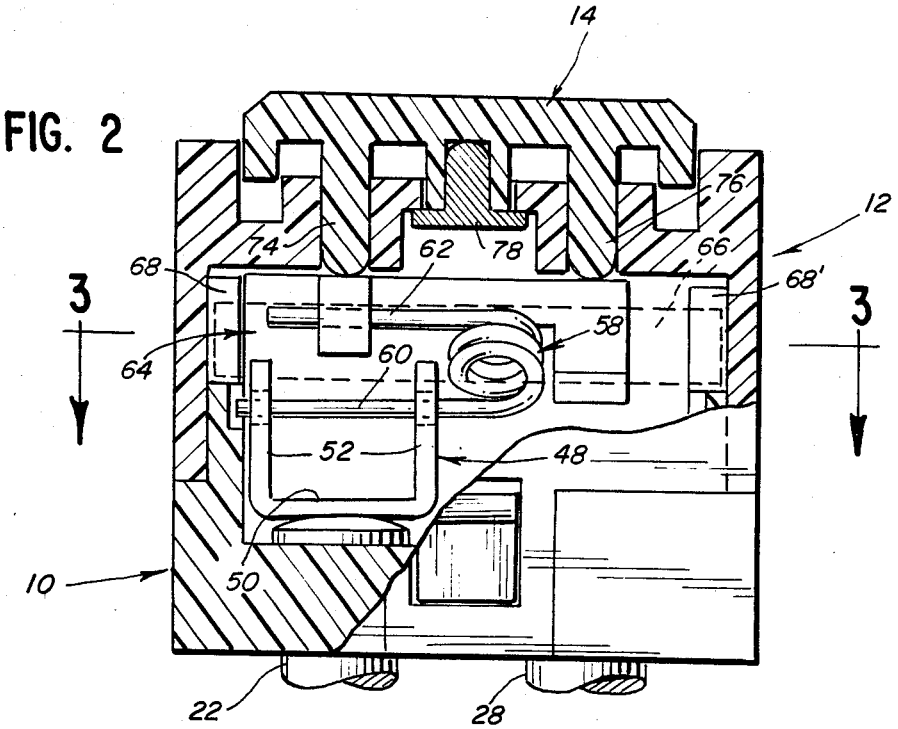
FIG. 2 is a vertical sectional view taken substantially along line 2—2 of FIG. 1.

FIGS. 2 and 3 show a torsion spring 58 which assists in controlling the position of the contactor 48 and affords a snap-action to movement of the contactor when the switch is actuated. The torsion spring 58 has one spring arm 60 which extends through openings in both of the upright contactor walls 52 (see FIGS. 2 and 3). A second spring arm 62 is seated in a groove formed beneath the outer end of a pivotally mounted actuator arm 64 (see FIG. 4A). The actuator arm 64 is also shown in FIG. 3 and comprises a rear end 65 which mounts on a transverse pivot pin 66. The pin 66 extends between a pair of lugs 68 and 68' (see FIG. 2) which are integral with base member 10. Thus, pin 66 is fixedly mounted relative to the base, while actuator arm 64 is pivotally mounted on pin 66. The other end of actuator arm 64 is bifurcated into two arm members 70 and 72 as shown in FIG. 3, and torsion spring 58 is positioned between the foregoing arms.

The torsion spring 58 is constructed so that the two spring arms 60 and 62 are biased away from one another. Referring again to FIG. 4A, it will now be understood that, by means of torsion spring 58, spring arm 60 is urging contactor 48 in a clockwise direction about pivot 54, while spring arm 62 is urging actuator 64 in a counterclockwise direction about pivot pin 66. The push button 14 is mounted in the cover 12 for vertical movement to move actuator arm 64 from the position shown in FIG. 4A. Push button 14 is generally rectangular as shown in FIG. 1, and it comprises a pair of depending cylindrical legs 74 and 76 (see FIG. 2) which slide in appropriate corresponding openings in cover 12 to guide vertical movement of the push button.

FIG. 2 shows a rivet fastener 78 which is pressed into an aperture in the underside of the button 14 and abuts against a portion of cover 12 for limiting upward movement of button 14 relative to cover 12. It will be understood that a second actuator arm 64 may be mounted on the other end of pivot pin 66 alongside the first actuator 64 so as to extend into the left half of the housing as viewed in FIG. 3, in which case the second actuator arm 64 could cooperate with a second contactor 48 as described hereinabove and be operated from the second push button shown at 16 in FIG. 1. Since the structure of a second actuator arm would be the same as for the arm 64 described above, only the one actuator will be described herein.

Before describing the operation of the switch of the present invention, it will be noted that the contactor 48 includes a left-hand end 80 (see FIG. 4A) which is an extension of the base 50, and as shown in FIG. 5, extension 80 is bifurcated at its end to form two contact arms 82 and 84. The contact arms 82 and 84 are intended to engage and make electrical contact with the conductor plate section 36 when the contactor 48 is pivoted from its clockwise position of FIG. 4A to its counterclockwise position shown in FIG. 4C. FIG. 5 shows the manner in which the bifurcated contact arms 82 and 84 straddle the contact rivet 18 so as to engage directly against the conductive sheet member 36.

FIG. 4A shows the manner in which a thin metal leaf spring 86 is affixed to the top of contactor extension 80 by means of a rivet fastener 88, and the outer end of leaf spring 86 has a cylindrical metal contact 90 welded to its underside. The leaf spring 86 is positioned centrally on the contactor extension 80 so it lies between the bifurcated contact arms 82 and 84 and thereby positions contact 90 intermediate contact arms 82 and 84 as shown in FIG. 5.

The operation of the foregoing switch assembly will now be described. As previously explained, contactor 48 is shown in FIG. 4A in its clockwise or neutral position in which it makes a circuit between contact rivets 20 and 22. In order to actuate the switch, an operator presses down on push button 14 so that depending button members 74 and 76 engage and press down on actuator arm 64 causing the latter to pivot in a clockwise direction about pivot pin 66.

It is important to understand the action of the torsion spring 58 during the foregoing clockwise movement of actuator arm 64. As shown in the position of FIG. 4A, it will be seen that a line through the two spring arms 60 and 62 passes below pivot 54, and thus contactor 48 is biased to its clockwise position shown. However, when actuator arm 64 is pivoted clockwise, spring arm 62 is moved downwardly relative to the stationary spring arm 60 until it reaches a point where a line drawn through the spring arms 60 and 62 passes above pivot 54, at which time the spring force on contactor 48 biases the contactor in a counterclockwise direction rather than a clockwise direction. As button 14 is moved down to its limiting position, it will thus be understood that the moment applied to contactor 48 changes and a snap action is effected as the contactor 48 is snapped quickly to its counterclockwise position shown in FIG. 4C. On the other hand, it will be noted that at all times a line drawn between the spring arms 60 and 62 causes a counterclockwise moment to be applied by spring arm 62 to actuator arm 64, and thus push button 14 is always biased upwardly.

An important feature of the present invention concerns the action of leaf spring 86 and contact 90 during the foregoing snapping of contactor 48 to the counterclockwise position of FIG. 4C. Referring to FIG. 4B, it will be seen that as contactor 48 pivots counterclockwise, contact 90 first engages contact rivet 18 thereby making a circuit between the contact rivets 18 and 20 and opening the circuit between contact rivets 20 and 22.

It will further be seen from FIG. 4B that when contact 90 first engages contact rivet 18, contact arms 82 and 84 are still spaced from conductive plate section 36. However, as contactor 48 continues to move in the counterclockwise direction, leaf spring 86 is deflected upwardly as shown in FIG. 4C, until contact arms 82 and 84 have made contact with plate member 36 thereby making a second circuit between contact rivets 18 and 20. It will be understood from the foregoing that sequential contact is effected at two different contact points with the switch of the present invention. As contactor 48 moves from the position of FIG. 4A to the position of FIG. 4B, contact is first made between the contact 90 and contact rivet 18, and as the contactor continues to move to the position of FIG. 4C, contact is also made between arms 82 and 84 and conductive sheet 36 (see FIG. 5).

The foregoing sequential contacting at two different contact points can be utilized to reduce or eliminate arcing damage. In accordance with one embodiment of my invention, contact 90 is made of a low conductive metal such as tungsten to reduce arcing when the circuit is first made between the contact rivets 18 and 20. It would not be desirable to conduct a high current through the low conductive contact 90 for any length of time. However, due to the snap action feature afforded by torsion spring 58, contactor 48 moves very rapidly from the position of FIG. 4B to the position of FIG. 4C, and contact arms 82 and 84 are preferably made of a high conductive metal. In the foregoing manner, arcing at the initial contact 90 is reduced or eliminated, and no arcing occurs at the contact arms 82 and 84 which are the principal current-carrying contacts.

Since a metal such as tungsten is relatively expensive, another embodiment of my invention involves use of a less expensive but high conductive material such as copper for contact 90. In the latter case, arcing would not be reduced at contact 90, but nevertheless there will be no arcing damage to the principal current-carrying contact arms 82 and 84, because arcing will occur only at contact 90. The various sheet members 32, 34, 36 and 38, and the contactor member 48, are preferably made of a highly conductive metal such as copper.

It will be understood that the above-described advantage relative to arcing damage also occurs during breaking of a circuit. Thus, when the operator releases the depressed push button 14, the button is raised upwardly to its original position of FIG. 4A by the force of the torsion spring 58. As the actuator arm 64 pivots upwardly in a counterclockwise direction to return to the position of FIG. 4A, spring arm 62 raises up so that a line drawn between the spring arms 60 and 62 again passes below pivot point 54, thereby causing contactor 48 to snap back to its clockwise position of FIG. 4A.

As the contactor 48 begins to move clockwise, contact arms 82 and 84 immediately separate from conductive sheet 36, but the circuit between the contact rivets 18 and 20 is not broken until the position of FIG. 4B is reached, and then further movement causes contact 90 to separate from contact rivet 18, thereby breaking the circuit. Accordingly, any arcing will occur only at the contact 90, and not at the contact arms 82 and 84 which are the primary current-carrying contact members.

There are various means other than the leaf spring member 86 for achieving sequential contact at different contact points in accordance with the present invention. One example of an alternative embodiment is shown in FIGS. 6A and 6B where there is shown an L-shaped contact arm 92 which includes a flexible transverse arm portion 94. First contact 96 is mounted at the end of the L-shaped extension 94, and a second contact 98 is mounted at the point where the extension intersects the arm 92. In this alternative embodiment, contact arm 92 is arranged so that when moved downwardly as viewed in FIGS. 6A and 6B, the initial contact is made when contact 96 engages contact rivet 100, at which time contact 98 is still spaced from a conductive sheet 102. However, as contact arm 92 continues to move downwardly, extension 94 flexes until contact 98 engages conductive sheet 102. Thus, arcing may be concentrated as contact 96, or may even be eliminated if contact 96 is of a low conductive metal such as tungsten, and the primary current-carrying contact member 98 is thereby protected from arcing damage. Other embodiments for effecting sequential contact at different contact points may be utilized within the scope of the present invention.

FIG. 8 shows an alternative embodiment for actuating contactor 48. In this embodiment, the two push buttons 14 and 16 are eliminated, and actuator arm 64 and the second actuator which corresponds with push button 16 are also eliminated. In place of the foregoing components, there is provided a rocker arm 104 which is pivotally mounted on pivot pin 66. As shown in FIG. 8, spring arm 62 shown at the right end of the drawing is mounted in a groove formed beneath the right-hand end of rocker arm 104, and a similar spring arm 62' is mounted in a groove formed beneath the left-hand end of rocker arm 104. Rocker arm 104 functions in a manner quite similar to push buttons 14 and 16 of FIGS. 1–4, except one end of the rocker arm will rise when the opposite end is depressed. Other types of actuating mechanisms may be utilized within the scope of the present invention.

As partially explained hereinabove, the embodiment of FIGS. 1–5 and 6 may include two push buttons 14 and 16, two actuators 64 mounted side-by-side on pivot pin 66 and extending in opposite directions therefrom, and two contactors 48. One contactor 48 serves to make a circuit between the contact rivets 20 and 22 when in the position of FIG. 4A, and to make a circuit between the contact rivets 18 and 20 when in the position of FIG. 4C. In a similar manner, a second contactor 48 associated with the above-mentioned second actuator arm 64 may be utilized to make a circuit between contact rivets 24 and 26 when in its clockwise position, and to make a circuit between contact rivets 26 and 28 when in its counterclockwise position. The second actuator arm 64 and the second contactor 48 may simply be mirror images of the actuator arm 64 and contactor 48 described herein.

An electric switch of the type described herein is capable of handling high current without the use of relays, and it affords a low-travel type of switch which gives a tactile feel to the operator. In addition, such a switch will provide long life, because arcing damage is either eliminated entirely or is located away from the principal current-carrying contact members.

There are a great many possible applications for a switch constructed in accordance with the present invention. One such application would be as a motor reversal switch for a DC motor, but numerous other applications will be suggested to those skilled in the art.

I claim:

1. In an electric switch, means for effecting sequential contact at two different contact locations comprising, in combination, primary contact means made of a metal having relatively high conductivity, secondary contact means made of a metal having relatively low conductivity and mounted adjacent to said primary contact means, said secondary contact means being yieldingly biased to a position where it engages a mating contact before said primary contact means thereby causing deflection of said secondary contact means relative to said primary contact means until said primary contact means also engages said mating contact, and snap-action actuator means for producing rapid relative movement between said mating contact and said primary and secondary contact means so as to reduce the time interval between engagement of said secondary contact means with said mating contact and engagement of said primary contact means with said mating contact.

2. The invention defined in claim 1 where said snap-action actuator means includes a torsion spring having first and second spring arms biased away from one another, said torsion spring being located so that actuation of said switch causes said spring arms to be moved closer to one another until an over-center position is reached which produces said rapid relative movement.

3. An electric switch comprising, in combination, a plurality of contacts mounted on said switch, movable contactor means connected with at least one of said plurality of contacts, said contactor means including primary contact means positioned to engage a second one of said plurality of contacts when said switch is actuated to move said contactor means to a predetermined position thereby completing a circuit between said first and second ones of said plurality of contacts, and secondary contact means mounted on said contactor means, said secondary contact means being yieldably biased to a position where it engages said second one of said plurality of contacts before said primary contact means when said contactor means is moved to said predetermined position, thereby causing deflection of said secondary contact means relative to said contactor means until said primary contact means also engages said second one of said plurality of contacts, whereby sequential contact is made at two different contact locations, said electric switch including snap-action actuator means for producing rapid movement of said contactor means to said predetermined position to reduce the time interval between engagement of said secondary contact means with said second one of said plurality of contacts and engagement of said primary contact means with said second one of said plurality of contacts, said primary contact means being made from a metal having relatively high conductivity, and said secondary contact means being made from a metal having relatively low conductivity.

4. The invention defined in claim 3 where said secondary contact means is connected to said primary contact means by spring means which deflects when said secondary contact means engages said second one of said plurality of contacts.

5. The invention defined in claim 3 where said snap-action actuator means includes a torsion spring having first and second spring arms biased away from one another, said torsion spring being located so that actuation of said switch causes said spring arms to be moved closer to one another until an over-center position is reached which produces said rapid movement of said contactor means to said predetermined position.

* * * * *